US010456619B2

(12) United States Patent
Jennings

(10) Patent No.: US 10,456,619 B2
(45) Date of Patent: Oct. 29, 2019

(54) EXERCISE DEVICE AND RELATED METHODS THEREOF

(71) Applicant: Michael R. Jennings, Strasburg, VA (US)

(72) Inventor: Michael R. Jennings, Strasburg, VA (US)

( * ) Notice: Subject to any disclaimer, the term of this patent is extended or adjusted under 35 U.S.C. 154(b) by 198 days.

(21) Appl. No.: 15/831,785

(22) Filed: Dec. 5, 2017

(65) Prior Publication Data

US 2018/0214737 A1 Aug. 2, 2018

Related U.S. Application Data

(60) Provisional application No. 62/452,468, filed on Jan. 31, 2017.

(51) Int. Cl.
*A63B 23/035* (2006.01)
*A63B 21/00* (2006.01)
(Continued)

(52) U.S. Cl.
CPC ..... *A63B 23/03525* (2013.01); *A61H 1/0237* (2013.01); *A63B 21/0056* (2013.01); *A63B 21/00069* (2013.01); *A63B 21/0125* (2013.01); *A63B 21/0628* (2015.10); *A63B 21/154* (2013.01); *A63B 21/4034* (2015.10); *A63B 21/4039* (2015.10); *A63B 21/4047* (2015.10); *A63B 23/0405* (2013.01); *A63B 21/005* (2013.01); *A63B 2208/0228* (2013.01); *A63B 2208/0242* (2013.01); *A63B 2220/17* (2013.01);
(Continued)

(58) Field of Classification Search
CPC ..... A61H 1/0237; A63B 21/00069; A63B 21/005; A63B 21/0056; A63B 21/0125; A63B 21/0628; A63B 21/154; A63B 21/4034; A63B 21/4039; A63B 21/4047; A63B 23/03525; A63B 23/0405; A63B 2208/0228; A63B 2208/0242; A63B 2220/17; A63B 2220/833; A63B 2225/09; A63B 2225/093
See application file for complete search history.

(56) References Cited

U.S. PATENT DOCUMENTS

D137,394 S 4/1873 Tice
1,868,262 A 7/1932 Staley
(Continued)

*Primary Examiner* — Joshua Lee
(74) *Attorney, Agent, or Firm* — Matthew G. McKinney, Esq.; Allen, Dyer et al.

(57) ABSTRACT

An exercise device includes a main pulley configured to rotate about a hub and having a first surface, a second surface opposite to the first surface, and a peripheral surface. The exercise device also includes a lower pulley coupled to a resistance drum and a belt wrapped partially around the peripheral surface of the main pulley coupling the main pulley to the lower pulley. Brake lining is positioned inside the resistance drum and are configured to be adjusted inwardly and outwardly along interior sidewalls of the resistance drum. In addition, a cable is coupled to the brake lining to control an amount of resistance to a rotation of the resistance drum, and a crank shaft is coupled to a hub of the main pulley and configured to be operated by feet of an individual for rotating the main pulley about the hub against the resistance to exercise the individual.

20 Claims, 7 Drawing Sheets

(51) Int. Cl.

| | |
|---|---|
| ***A63B 23/04*** | (2006.01) |
| ***A63B 21/062*** | (2006.01) |
| ***A61H 1/02*** | (2006.01) |
| ***A63B 21/005*** | (2006.01) |
| ***A63B 21/012*** | (2006.01) |

(52) U.S. Cl.
CPC ..... *A63B 2220/833* (2013.01); *A63B 2225/09* (2013.01); *A63B 2225/093* (2013.01)

(56) References Cited

U.S. PATENT DOCUMENTS

| | | | | | |
|---|---|---|---|---|---|
| 2,530,921 | A | | 11/1950 | Tougas | |
| 3,007,280 | A | | 11/1961 | Berberich | |
| 3,309,084 | A | * | 3/1967 | Charles | A63B 21/015 482/62 |
| 3,758,107 | A | | 9/1973 | Potgieter | |
| 3,953,026 | A | | 4/1976 | Stokely | |
| 3,966,201 | A | * | 6/1976 | Mester | A63B 23/0355 482/72 |
| 4,171,801 | A | | 10/1979 | Bell | |
| 4,483,532 | A | | 11/1984 | Sparks | |
| 4,542,898 | A | | 9/1985 | Grushkin | |
| 4,600,189 | A | | 7/1986 | Olschansky et al. | |
| 4,611,807 | A | | 9/1986 | Castillo | |
| 4,749,182 | A | | 6/1988 | Duggan | |
| 4,947,831 | A | | 8/1990 | Crabtree | |
| 4,953,415 | A | | 9/1990 | Lehtonen | |
| 5,039,091 | A | | 8/1991 | Johnson | |
| 5,062,633 | A | | 11/1991 | Engel et al. | |
| 5,125,882 | A | | 6/1992 | La Mothe et al. | |
| 5,147,265 | A | * | 9/1992 | Pauls | A63B 21/015 482/115 |
| 5,356,362 | A | | 10/1994 | Becker et al. | |
| 5,511,740 | A | * | 4/1996 | Loubert | A63B 21/015 242/381 |
| 6,405,585 | B1 | | 6/2002 | Hewitt | |
| 6,413,192 | B2 | | 7/2002 | Abelbeck | |
| 6,547,701 | B1 | | 4/2003 | Eschenbach | |
| 7,794,365 | B2 | | 9/2010 | Daniel | |
| 7,998,044 | B2 | | 8/2011 | Long | |
| 8,529,416 | B2 | | 9/2013 | Jennings | |
| 2002/0004439 | A1 | * | 1/2002 | Galbraith | A63B 22/0605 482/57 |
| 2002/0107116 | A1 | | 8/2002 | Schulz | |
| 2005/0096192 | A1 | | 5/2005 | Chen | |
| 2007/0275829 | A1 | * | 11/2007 | Popescu | A63B 7/045 482/37 |
| 2009/0203508 | A1 | | 8/2009 | Hauser et al. | |
| 2010/0041520 | A1 | * | 2/2010 | Popescu | A63B 21/015 482/37 |
| 2012/0322625 | A1 | * | 12/2012 | Park | A63B 22/0012 482/62 |
| 2015/0174447 | A1 | * | 6/2015 | Chiang | A63B 22/0605 482/8 |
| 2015/0174449 | A1 | * | 6/2015 | Chiang | A63B 22/0605 482/6 |

* cited by examiner

FIG. 1
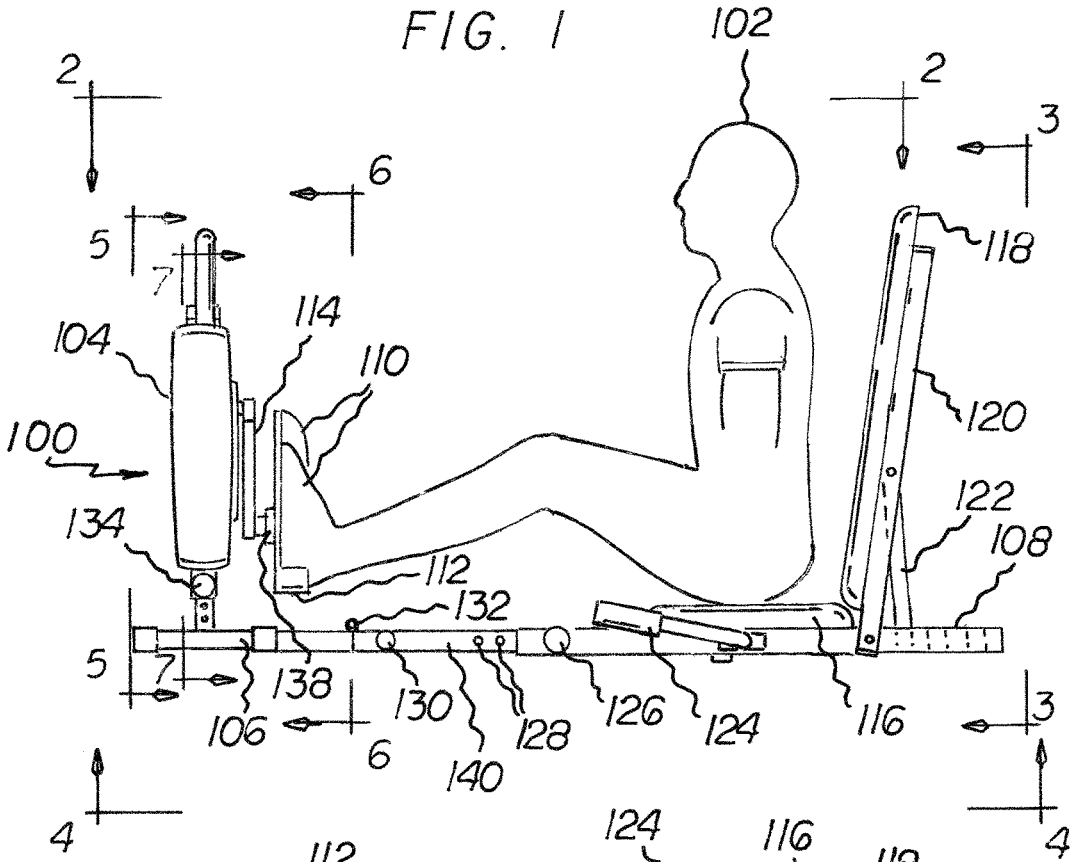
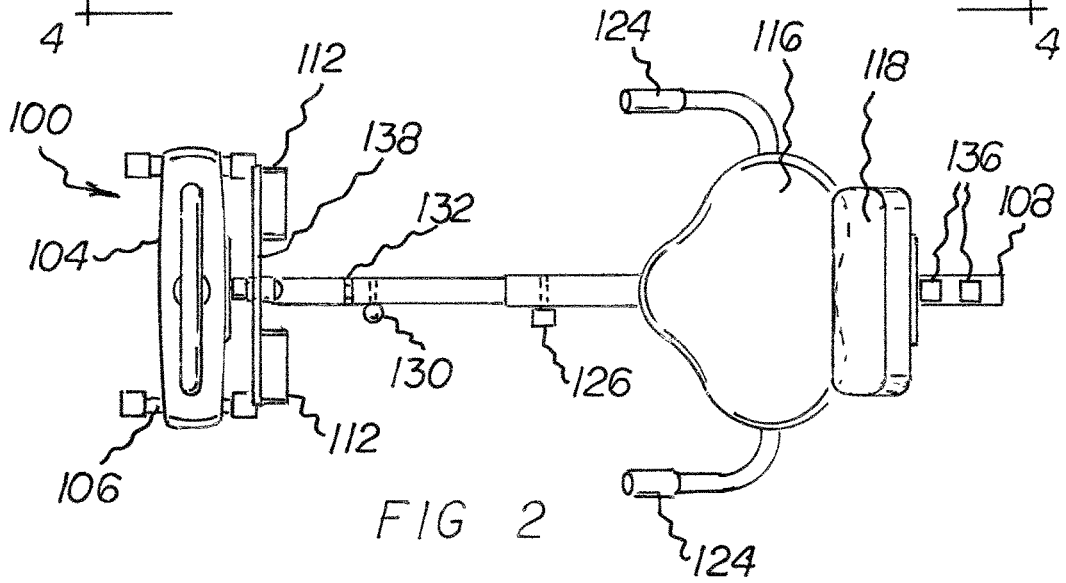
FIG 2

FIG. 9
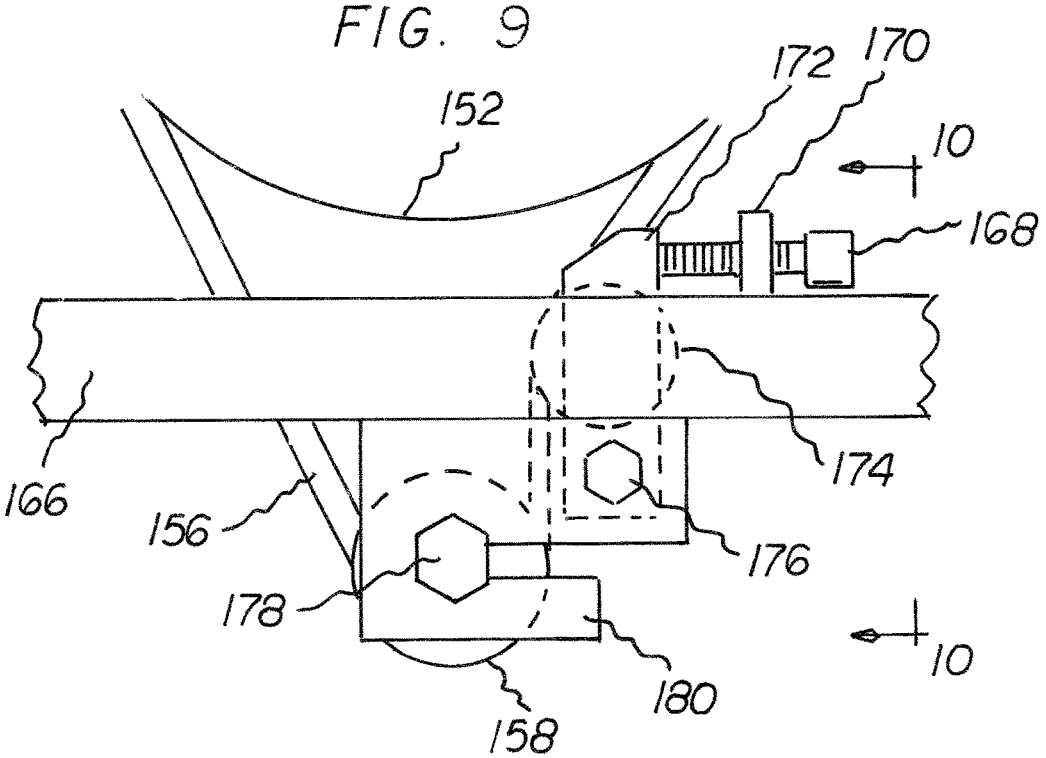
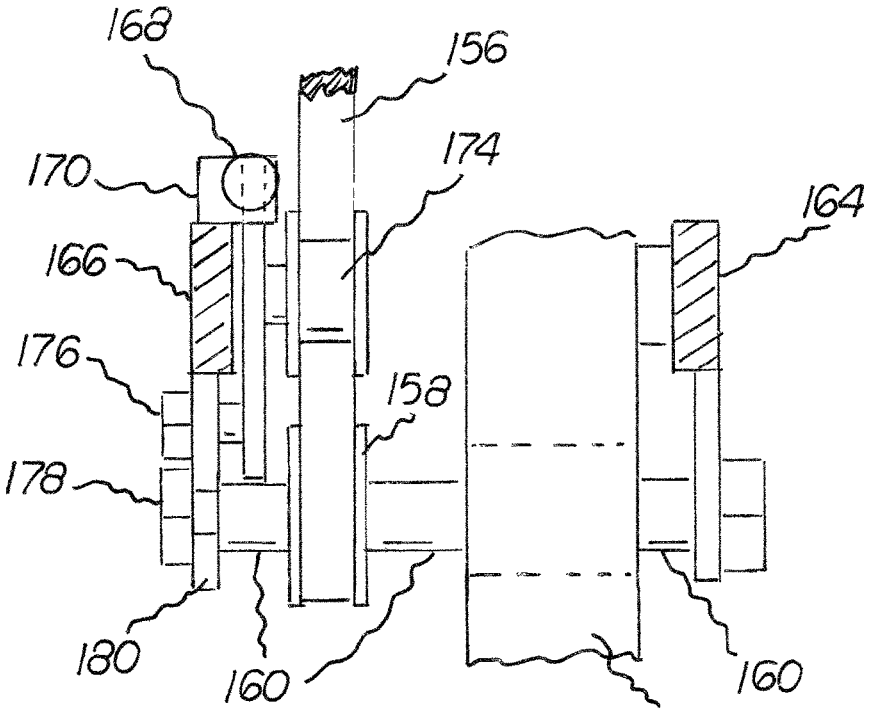
FIG. 10

FIG. 13
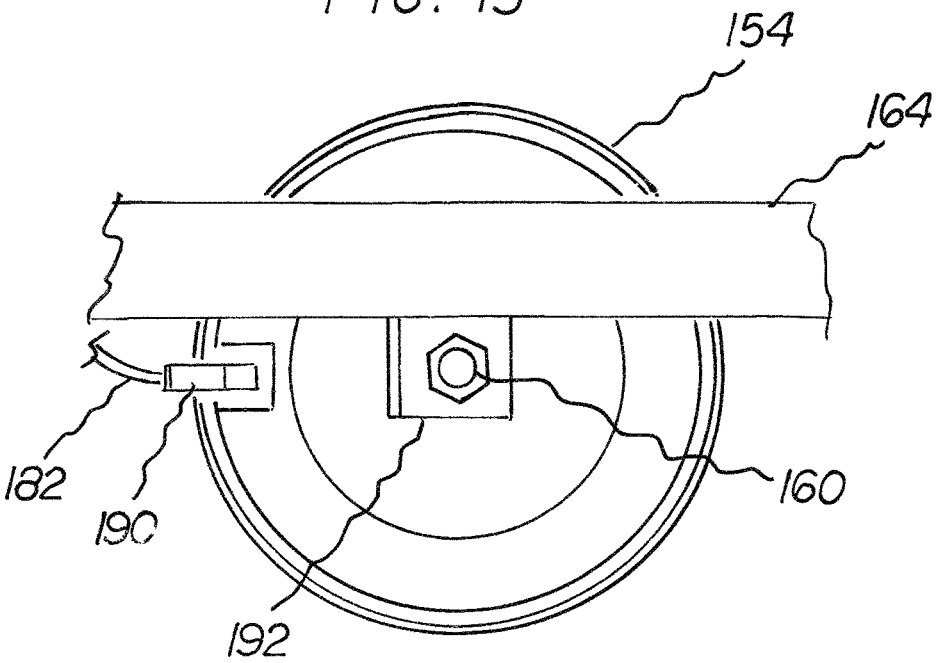
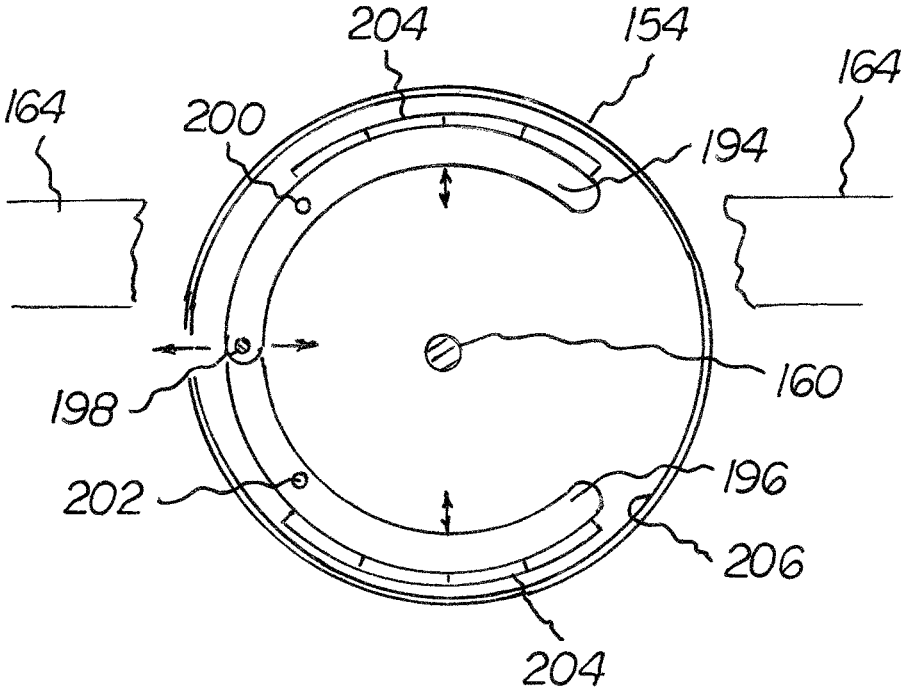
FIG 14

EXERCISE DEVICE AND RELATED METHODS THEREOF

RELATED APPLICATION

The present invention is related to U.S. Provisional Patent Application Ser. No. 62/452,468 filed Jan. 31, 2017, the entire contents of which are incorporated herein by reference.

TECHNICAL FIELD

The present disclosure generally relates to exercising equipment, and, more particularly, to an exercise device for exercising leg, abdomen, hip and back muscles of an individual.

BACKGROUND

Exercising may refer to a combination of one or more physical activities performed by an individual with an intention of gaining, maintaining or improving physical fitness of body. Such physical activities may include swimming, running, rowing, cycling, walking and the like. Certain physical activities are performed using various exercising equipment. Conventional exercising equipment is generally designed to simulate a specific physical activity to be performed repetitively, and, therefore the exercising equipment affects specific portions of the body only. Examples of the conventional exercising equipment may include, but are not limited to, treadmills, elliptical trainers, stationary bicycles and the like.

Generally, the conventional exercising equipment includes a complex arrangement of parts, and, therefore the conventional exercising equipment is cumbersome and bulky. Accordingly, such conventional exercising equipment is generally found only in gymnasiums, and having such conventional exercising equipment at home may be both difficult and inconvenient for the individuals.

Further, only a specific portion of the body gets affected since such conventional exercising equipment is designed for a specific physical activity to be performed repetitively. Accordingly, other parts of the body adjacent to the specific portions of the body remain unaffected.

Furthermore, the conventional exercising equipment requires the individuals to apply a constant amount of effort for performing the specific physical activity, and, therefore the individuals are devoid of an option of varying the amount of effort for performing the specific physical activity on the conventional exercising equipment.

SUMMARY

In view of the foregoing background, it is therefore an object of the present invention to provide an exercise device that is easy to use and that is effective. The exercise device includes a main pulley configured to rotate about a hub and having a first surface, a second surface opposite to the first surface, and a peripheral surface. The exercise device also includes a resistance drum coupled to a lower pulley via a lower shaft, and a belt wrapped partially around the peripheral surface of the main pulley coupling the main pulley to the lower pulley. Brake lining is positioned inside the resistance drum and are configured to be adjusted inwardly and outwardly along interior sidewalls of the resistance drum. In addition, a cable is coupled to the brake lining to control an amount of resistance to a rotation of the resistance drum, and a crank shaft is coupled to a hub of the main pulley and configured to be operated by feet of an individual for rotating the main pulley about the hub against the resistance to exercise the individual.

In another aspect, a method of exercising is disclosed. The method includes positioning feet of an individual within the pair of foot rests, and selectively adjusting a resistance to a rotation of the main pulley using the resistance drum. The method also includes performing exercises by rotating the foot rests using the feet of the individual in a twisting motion to the left and right about the center hub as the individual is seated or laying down.

BRIEF DESCRIPTION OF THE DRAWINGS

FIG. 1 is a left side elevational view of a particular embodiment of the exercise device;

FIG. 2 is a top view of the exercise device;

FIG. 9 is a partial front view of the exercise device taken in direction of circle 9 in FIG. 7;

FIG. 10 is a partial elevation view taken in the direction of line 10-10 in FIG. 9;

FIG. 13 is an partial view of a resistance drum taken in the direction of circle 13 in FIG. 11; and FIG. 14 is a cross sectional view of the resistance drum of FIG. 13.

DETAILED DESCRIPTION

Figure 3:
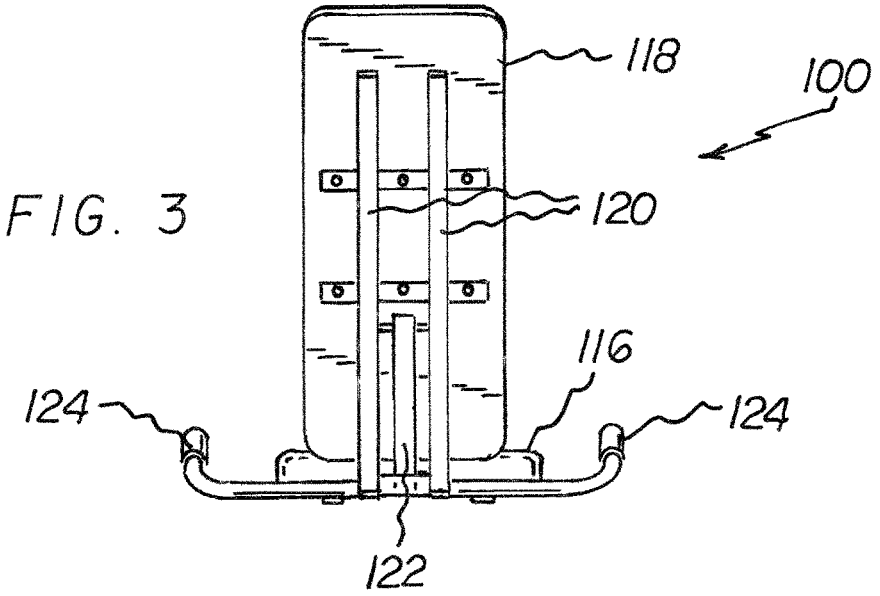
FIG. 3 is a rear view of the exercise device.
Figure 4:
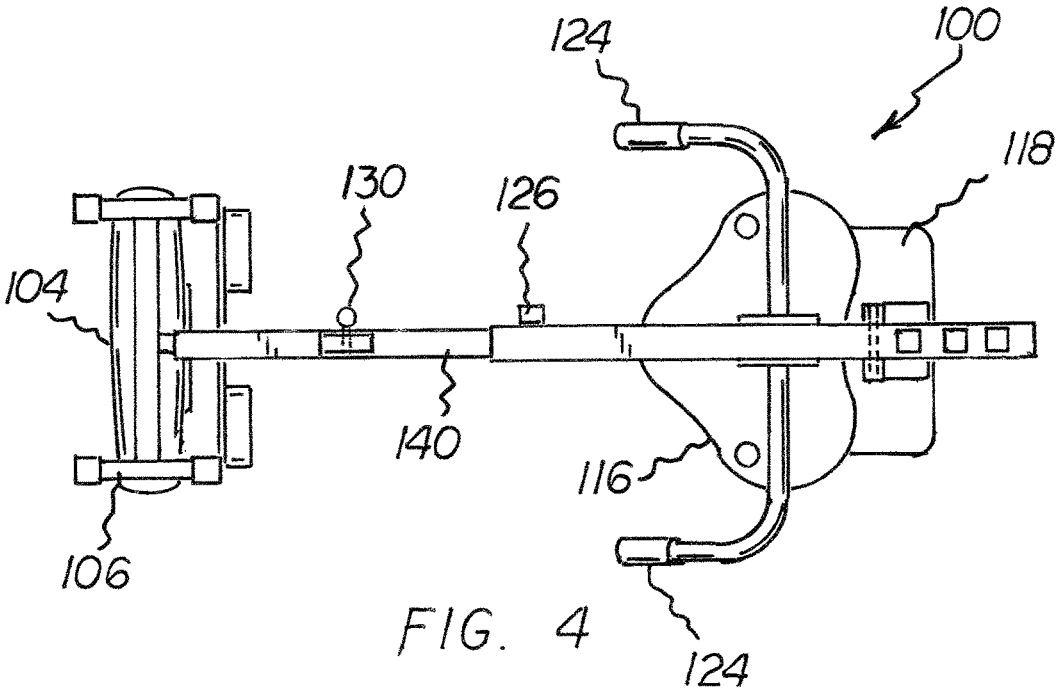
FIG. 4 is a bottom view of the exercise device.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring now to FIGS. 1-4, an exercise device is generally designated 100. The exercise device is configured for an individual 102 to typically sit or lay down to use the exercise device 100. As the individual 102 is positioned within the device 100, a housing 104 is located proximate to feet 110 of the individual 102.

A crank shaft 114 is connected to a footrest cross member 138 having a pair of foot rests 112 adjacent to the housing 104. The foot rests are configured to receive the feet 110 of an individual 102 as explained below.

The housing 104 is supported in a vertical position by a housing support structure 106. An elongated horizontal member 108 has a first end connected to the bottom of the housing 104 which is supported by the housing support structure 106. A seat 116 and backrest 118 are spaced apart from the housing 104 a distance on the elongated horizontal member 108 that allows the individual 102 to have bent knees when exercising. A pair of handles 124 are connected to the elongated horizontal member 108 are positioned on each side of the seat 116 so that an individual 102 exercising can grasp each handle 124 with a respective hand.

Backrest supports 120 are on a rear surface of the back rest 118 and are coupled to the elongated horizontal member 108. A backrest strut 122 is used to adjust an angle of the backrest 118 using a series of adjustment holes 136 disposed within the elongated horizontal member 108. A first end of the backrest strut 122 is secured to a rear side of the backrest 118, and the second free end is configured to be inserted into the desired adjustment hole 136.

The distance of the seat 116 to the foot rests 112 is also adjustable using an adjustment pin 126. The adjustment pin 126 is configured to be removed from a series of length adjustment holes 128 to allow a telescoping sliding portion 140 of the elongated horizontal member 108 to slide in order to change a position of the seat 116 relative to the foot rests 112. The adjustment pin 126 can then be reinserted into the desired length adjustment hole 128 to secure the telescoping sliding portion 140 in place.

The elongated horizontal member 108 also includes a hinge pin 132 that allows the elongated horizontal member 108 to fold up towards the housing 104 when knob 130 is pulled. Accordingly, this collapsible feature allows the exercise device 100 to be stored in a smaller place.

Figure 5:
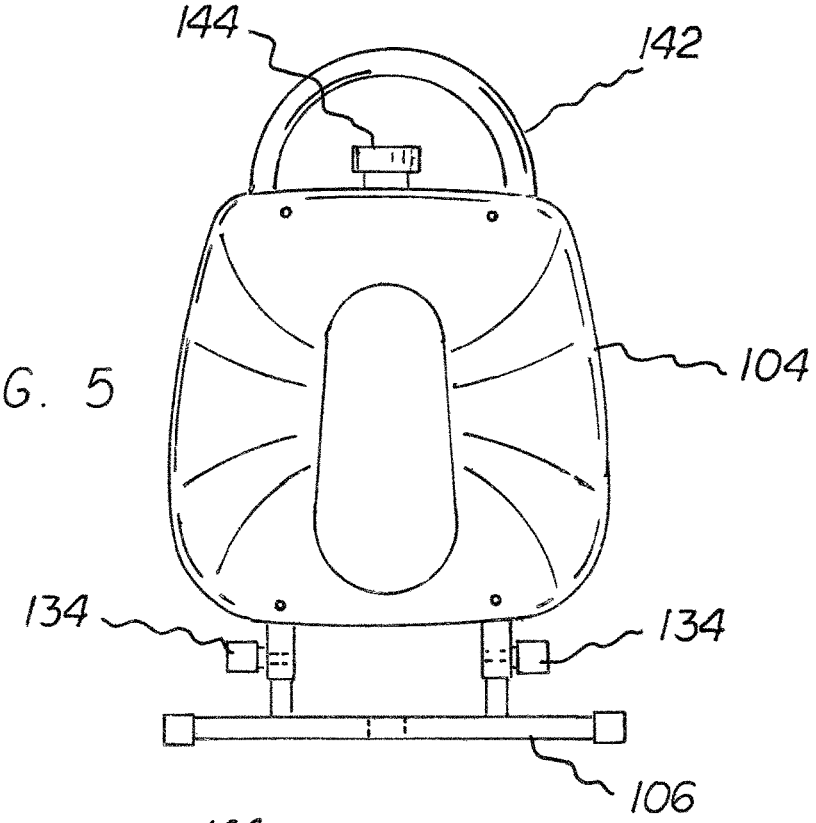
FIG. 5 is a view of the exercise device taken in the direction of line 5-5 in FIG. 1.

Referring now to FIG. 5, in addition, the height of the housing 104 and foot rests 112 can be adjusted using height adjustment knobs 134 so that the foot rests 112 are in a comfortable position for the individual 102. The height adjustment knobs 134 can be retracted to allow the housing 104 to be moved upwards or downwards incrementally along the housing support structure 106. Once the desired height is reached, the height adjustment knobs 134 can be released to secure the housing 104 at that desired height.

Figure 6:
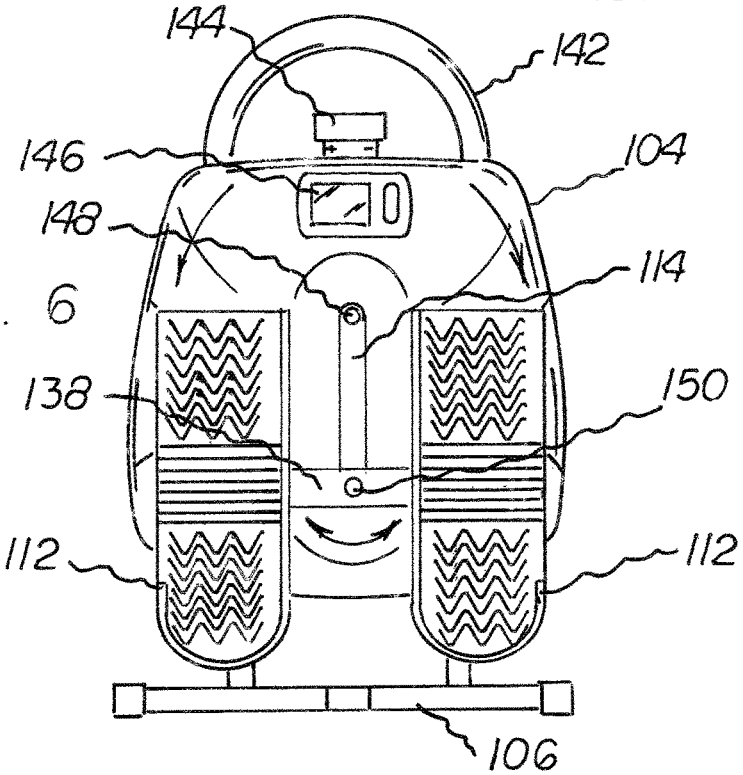
FIG. 6 is a view of the exercise device taken in the direction of line 6-6 in FIG. 1.

As shown in FIG. 6, the foot rests 112 are configured to receive feet 110 of the individual. In particular, the foot rests 112 are coupled to the footrest cross member 138 by pivot 150. Thus, the foot rests 112 are able to pivot back and forth when the individual 102 is exercising. At the top of the housing 104 is a handle 142 that is configured for the individual 102 to carry the exercise device 102. A resistance dial 144 disposed at the top of the housing 104 is used to control an amount of resistance when exercising as described below.

Figure 7:
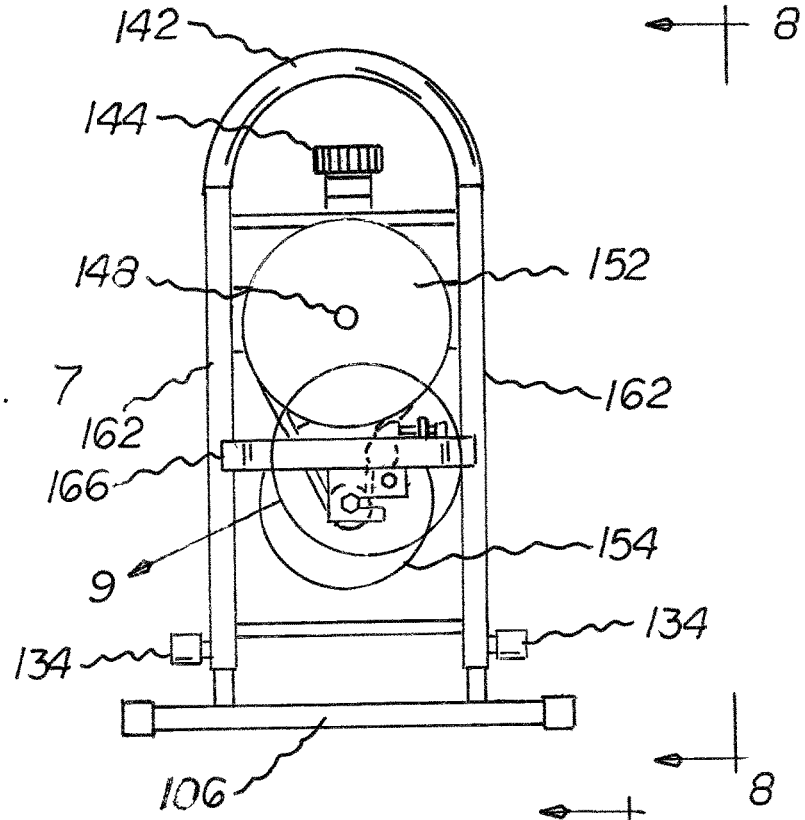
FIG. 7 is a front view of the exercise device with a housing removed.
Figure 8:
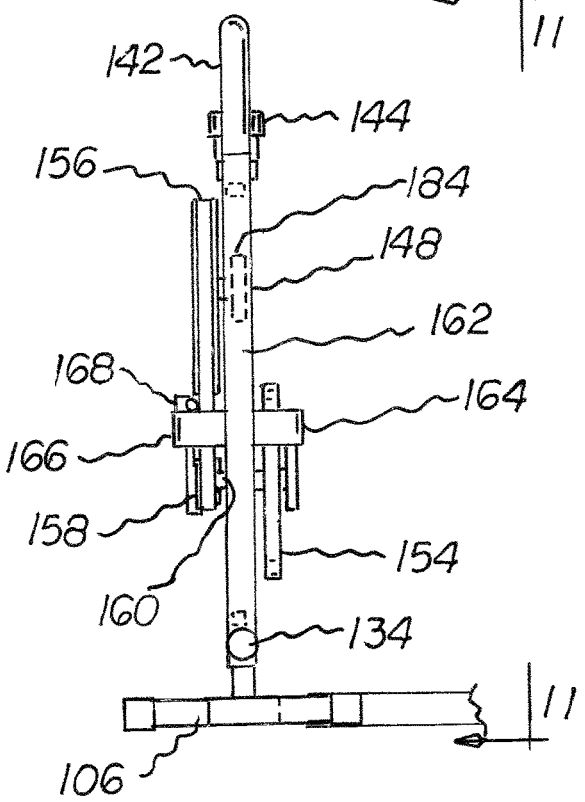
FIG. 8 is an elevational view taken in the direction of line 8-8 in FIG. 7.

The housing 104 is removed in FIGS. 7 and 8 for clarity. In particular, a main pulley 152 is configured to rotate about a hub 148 that is connected to the crank shaft 114. The main pulley 152 comprises a first surface, a second surface opposite to the first surface, and a peripheral surface. A resistance drum 154 is coupled to a lower pulley 158 via a lower shaft 160, and has an adjustably engaging relationship to the main pulley 152.

A belt 156 is wrapped partially around the peripheral surface of the main pulley 152 and the lower pulley 158, thereby coupling the main pulley 152 to a rotation of the resistance drum 154. The crank shaft 114 is coupled to the hub 148 of the main pulley 152 and is configured to be operated by the feet 110 of an individual 102 for rotating the main pulley 152 about the hub 148 against the resistance to exercise the individual 102.

The exercise device 100 includes vertical members 162 and a front horizontal support 164 and a rear horizontal support 166 therebetween. The front horizontal support 164 is used to mount the resistance drum 154 to a front side of the horizontal supports 164, and the rear horizontal support 166 is used to mount the tension bearing 174 and the lower pulley 158 on a rear side of the vertical supports 162.

Referring now to FIGS. 9 and 10, the exercise device 100 includes an adjustable tension bearing 174 mounted to a bearing guide 172 and disposed between the main pulley 152 and the lower pulley 158 that is connected to the resistance drum 154 via the lower shaft 160. The adjustable tension bearing 174 is configured to be moved or tilted towards the lower pulley 158 to increase a tension in the belt 156. The adjustable tension bearing 174 is coupled to a bearing pin 176 so that, for example, as the adjustment bolt 168 is rotated through threaded tab 170 in a first direction, a top portion of the bearing guide 172 pivots about bearing pin 176 and moves inwards towards the lower pulley 158. This action causes the belt 156 to tighten.

Similarly, rotating the adjustment bolt 168 in an opposite direction will cause the top portion of the bearing guide to move away from the lower pulley 158 causing the belt 156 to have less tension. In addition, the lower pulley 158 may be adjusted by moving the position of the shaft bolt 178 within a slotted plate 180 that is suspended from the rear horizontal support 166 as shown in FIG. 9.

The lower pulley 158 is spaced apart from the resistance drum 154 via the lower shaft 160 and couples a center hub of the resistance drum 154 to the lower pulley 158, where the lower pulley 158 is positioned directly under the main pulley 152.

Figure 11:
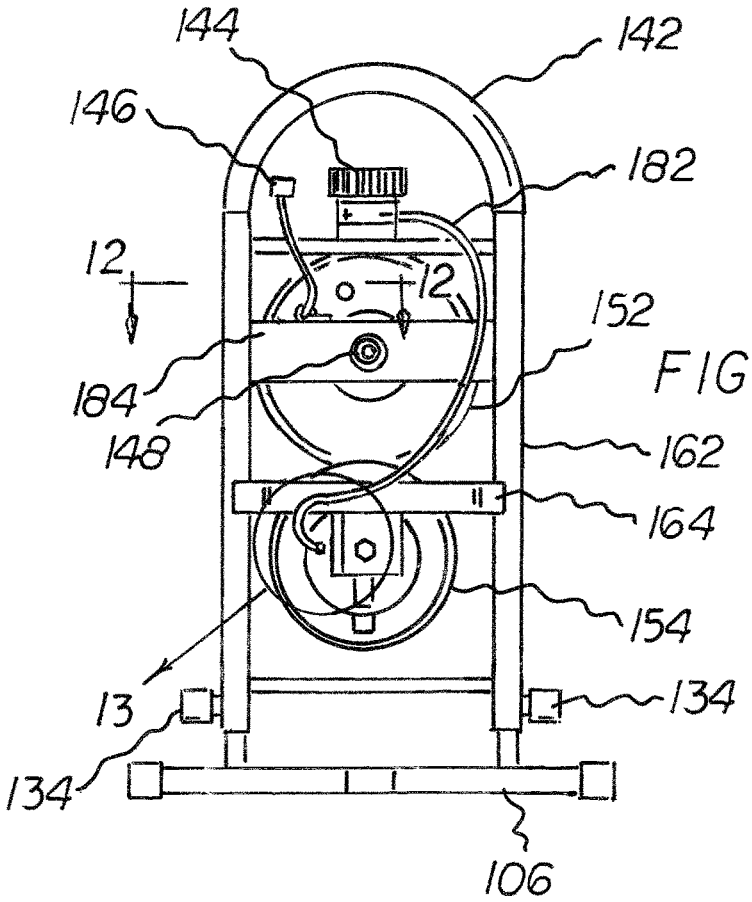
FIG. 11 is a rear view of the exercise device with the housing removed.

Referring now to FIG. 11, the exercise device 100 may also include a dial 144 coupled to a cable 182 connected to the resistance drum 154. The dial 144 is used to select a level of resistance to the rotation of the main pulley 152. For example, when the dial 144 is turned in a first direction it results in an increase in resistance to the rotation of the main pulley 152, and when turned in an opposing second direction it results in a decrease in the resistance to the rotation of the main pulley 152. The main pulley 152 is mounted to a main horizontal support 184 that spans between the vertical supports 162 and above the resistance drum 154 and the lower pulley 158.

Figure 12:
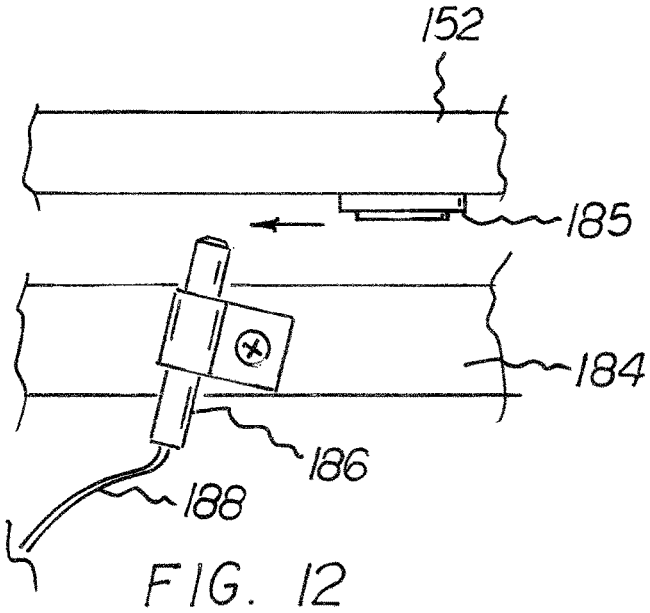
FIG. 12 is a partial view taken in the direction of line 12-12 in FIG. 11.

A mechanism to count the number of rotations includes a magnet 185 that is mounted to the main pulley 152, as shown in FIG. 12. A sensor 186 is mounted to the main horizontal support 184 and is configured to register each time the magnet 185 passes to count a number of rotations. The sensor 186 may be configured to operate using the Hall effect, or magnetic reed switch, or other known methods as can be appreciated by those of ordinary skill in the art. Alternatively, the sensor 186 may be attached to the main pulley 152.

Referring now to FIGS. 13 and 14, the resistance drum 154 is shown mounted to a support arm 192 of the front horizontal support 164. As explained above, the lower shaft 160 is coupled to the resistance drum 154 and lower pulley 158. Brake lining 204 is mounted to shoes 194, 196 and is positioned inside the resistance drum 154.

The brake lining 204 of shoes 194, 196 is configured to be adjusted inwardly and outwardly along interior sidewalls 206 of the resistance drum 154. The cable 182 is coupled to the resistance drum 154 via cable guide 190. The cable guide 190 in turn is connected to a hinge point 198 inside the resistance drum 154 where the shoes 194, 196 are connected at a respective first end. As the cable 182 moves in a first direction it results in the first end of the shoes 194, 196 pivoting about a respective shoe pivot 200, 202 and the brake lining 204 engaging the inside sidewalls 206 (either mechanically or magnetically).

The brake lining 204 may comprise a magnetic material having a first polarity, and the inside sidewalls 206 of the resistance drum 154 having an opposing second polarity. Accordingly, the resistance can be implemented using magnetic forces instead of friction. Alternatively, the brake lining 204 may physically engage the interior sidewalls 206 to provide the resistance mechanically via friction.

In another aspect of the invention, a method of exercising using the exercise device described above and in the drawings is disclosed. The method includes positioning feet of an individual within the pair of foot rests, selectively adjusting a resistance to a rotation of the main pulley using the resistance drum, and performing exercises by rotating the foot rests using the feet of the individual in a twisting motion to the left and right about the center hub as the individual is seated or laying down.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the invention.

That which is claimed is:

1. An exercise device comprising:

a main pulley configured to rotate about a hub and having a first surface, a second surface opposite to the first surface, and a peripheral surface;

a lower pulley;

a resistance drum coupled to the lower pulley and having an adjustably engaging relationship to the main pulley;

a belt wrapped partially around the peripheral surface of the main pulley and the lower pulley;

brake lining positioned inside the resistance drum and configured to be adjusted inwardly and outwardly along interior sidewalls of the resistance drum;

a cable coupled to the brake lining to control an amount of resistance to a rotation of the resistance drum; and a crank shaft coupled to a hub of the main pulley and configured to be operated by feet of an individual for rotating the main pulley about the hub against the resistance to exercise the individual.

2. The exercise device of claim 1, further comprising an adjustable tension bearing disposed between the main pulley and the lower pulley, wherein the adjustable tension bearing is configured to be moved towards the lower pulley to increase a tension in the belt.

3. The exercise device of claim 1, further comprising a lower shaft coupling a center hub of the resistance drum to the lower pulley, wherein the lower pulley is positioned directly under the main pulley.

4. The exercise device of claim 1, wherein the brake lining comprises a magnetic material having a first polarity, and inside sidewalls of the resistance drum having an opposing second polarity.

5. The exercise device of claim 1, further comprising a dial coupled to the cable, wherein when the dial is turned in a first direction results in an increase in a resistance to the rotation of the main pulley, and when turned in an opposing second direction results in a decrease in the resistance to the rotation of the main pulley.

6. The exercise device of claim 1, further comprising a structural frame having a pair of vertical members, wherein the main pulley, the resistance drum and the lower pulley being mounted between the pair of vertical members.

7. The exercise device of claim 6, further comprising an elongated horizontal member having a first end and a second end, the first end secured to a bottom of the structural frame and the second end extending away from the structural frame.

8. The exercise device of claim 7, further comprising a seat and adjustable back rest secured to the elongated horizontal member.

9. The exercise device of claim 1, further comprising a pair of footrests coupled to the crank shaft and configured to receive a portion of the feet of the individual therein.

10. The exercise device of claim 6, wherein a magnet is mounted to the main pulley, and a sensor is mounted to the structural frame and configured to register each time the magnet passes to count a number of rotations.

11. The exercise device of claim 8, wherein the elongated horizontal member comprises a hinge pin between the structural frame and the seat and backrest, wherein the hinge pin is configured for the elongated horizontal member to fold upwards towards the structural frame.

12. An exercise device comprising:

a vertical frame;

a main pulley comprising a center hub, the main pulley mounted to the vertical frame by the center hub;

a pair of foot rests coupled to the main pulley on a first side;

a resistance drum;

a lower shaft;

a lower pulley coupled to the resistance drum via the lower shaft;

a belt coupling the main pulley to the lower pulley; and brake lining positioned inside the resistance drum and configured to be adjusted inwardly and outwardly along interior sidewalls of the resistance drum.

13. The exercise device of claim 12, further comprising a crank shaft coupled to the center hub of the main pulley and the pair of foot rests, the crank shaft configured to be operated by feet of an individual for rotating the main pulley against the resistance to exercise the individual.

14. The resistance device of claim 13, further comprising a cable coupled to the brake lining to control an amount of resistance to a rotation of the resistance drum.

15. The exercise device of claim 12, further comprising an adjustable tension bearing disposed between the main pulley and the lower pulley, wherein the adjustable tension bearing is configured to be moved relative to the lower pulley to change a tension in the belt.

16. The exercise device of claim 12, wherein the brake lining comprises a magnetic material having a first polarity, and inside sidewalls of the resistance drum having an opposing second polarity.

17. The exercise device of claim 12, further comprising an elongated horizontal member having a first end and a second end, the first end secured to a bottom of the vertical frame and the second end extending away from the vertical frame.

18. The exercise device of claim 17, further comprising a seat and adjustable back rest secured to the elongated horizontal member.

19. The exercise device of claim 18, wherein the elongated horizontal member comprises a hinge pin between the vertical frame and the seat and backrest, wherein the hinge pin is configured for the elongated horizontal member to fold upwards towards the vertical frame.

20. A method of exercising using an exercise device comprising a vertical frame, a main pulley having a center hub mounted to the vertical frame, a pair of foot rests coupled to the main pulley on a first side, a resistance drum, a lower shaft, a lower pulley coupled to the resistance drum via the lower shaft, a belt coupling the main pulley to the lower pulley, and brake lining positioned inside the resistance drum and configured to be adjusted inwardly and outwardly along interior sidewalls of the resistance drum, the method comprising:

positioning feet of an individual within the pair of foot rests;

selectively adjusting a resistance to a rotation of the main pulley using the resistance drum; and performing exercises by rotating the foot rests using the feet of the individual in a twisting motion to the left and right about the center hub as the individual is seated or laying down.

* * * * *